United States Patent [19]

Hinckley

[11] 4,235,440

[45] Nov. 25, 1980

[54] DEVICE FOR ALIGNING THE FACE AND SWING OF A GOLF CLUB

[76] Inventor: Anne F. Hinckley, Hope, R.I.

[21] Appl. No.: 5,001

[22] Filed: Jan. 22, 1979

[51] Int. Cl.[3] ..... A63B 69/36

[52] U.S. Cl. ..... 273/183 A; 273/186 C

[58] Field of Search ..... 273/183 A, 186 C, 183 D, 273/183 E, 186 A, 187 A; D21/234

[56] References Cited

U.S. PATENT DOCUMENTS

| | | | |
|---|---|---|---|
| D. 205,041 | 6/1966 | Capps | D21/234 |
| 2,992,005 | 7/1961 | Lockhart | 273/186 C |
| 3,934,874 | 1/1976 | Henderson | 273/183 A X |
| 3,934,882 | 1/1976 | Whittaker | 273/183 A |

FOREIGN PATENT DOCUMENTS

| | | | |
|---|---|---|---|
| 325149 | 2/1930 | United Kingdom | 273/183 A |

*Primary Examiner*—George J. Marlo

[57] ABSTRACT

A device for aligning the face and swing of a golf club comprising an elongated body having parallel sides with a direction line extending midway of the body and a series of arrows having their points on the center line and each arrow with a base at right angles to the center line extending from edge to edge of the body.

3 Claims, 3 Drawing Figures

DEVICE FOR ALIGNING THE FACE AND SWING OF A GOLF CLUB

BACKGROUND OF THE INVENTION

Various devices have been known to assist in the swinging of a golf club and to align its face in connection with the golf club swing. These have sometimes taken the form of mats upon which the player may stand with teeing arrangements and sometimes these may be devices to be placed on the ground oriented in a certain direction with relation to the direction the golf ball may be hit, such as in U.S. Pat. No. 2,992,005.

SUMMARY OF THE INVENTION

The device of this invention is relatively small and may be laid either back of or in front of the golf ball to be stroked. It has parallel edges with a direction line extending midway between the edges and with arrows raised on the surface of the body, each pointing along the direction line and each with a base at right angles to the direction line so that the face of the golf club may be aligned with the base of the arrow or with end portions of the device, one of the end portions being flared to assist in this alignment. The arrows may be provided with some sort of a surface to contrast with the body such as a different color or some such means. Further, the device will have arrows pointing in opposite directions on opposite side surfaces so that the device may be used either for short shots or putts and for long shots from the tee or the fairway by choosing one side surface or the other.

DESCRIPTION OF THE PREFERRED EMBODIMENT

Figure 1:
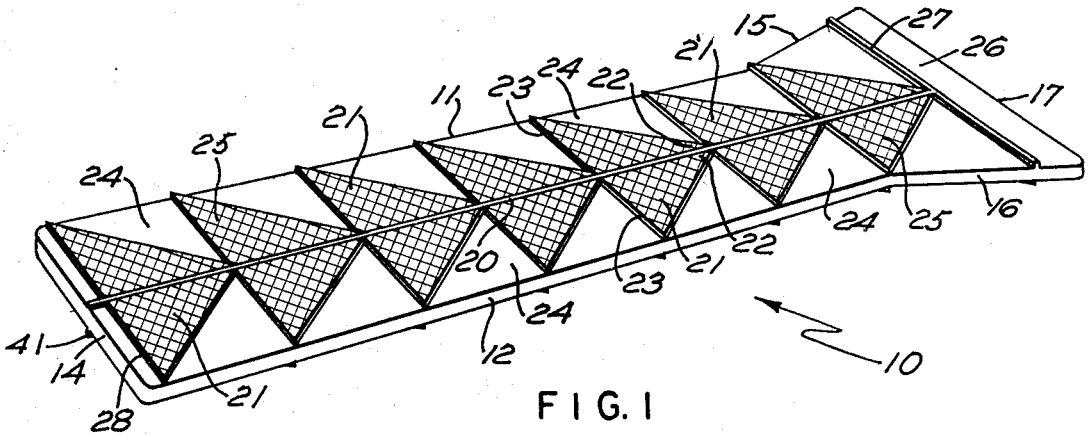
FIG. 1 is a perspective view of the device showing the side thereof which is used for short shots.

In FIG. 1 the body of the device is designated 10 and will be formed about $\frac{1}{8}$ of an inch in thickness out of some relatively stiff but somewhat flexible material which may be a fiber, plastic composition or rubber. The body is of elongated configuration having opposite parallel edges 11 and 12 with an end 14 at right angles to the edges 11 and 12 and with flaring portions 15 and 16 from either edge to an end 17 which is also at right angles to the parallel edges 11 and 12. A directional line 20 extends along the center of the body substantially from end to end and is of a width to be prominent when viewing the top surface of the device. Arrows 21 of generally triangular shape having point ends 22 and base ends 23 are raised on the surface 24 of the body about 1/32 of an inch and may be contrasted with the surface of the body by some color or lining configuration 25. These arrows are arranged in tandem relation along substantially the full length of the body but leave a space as at 26 at the flared end of the body where a club face aligning marker 27 extends laterally of the body from edge to edge and is parallel to the end 17 of the body. Likewise, such a marker 28 extends across the body at its other end also spaced from the end 14 and is a right angles to the direction line 20 and the parallel edges 11 and 12 of the body.

Figure 2:
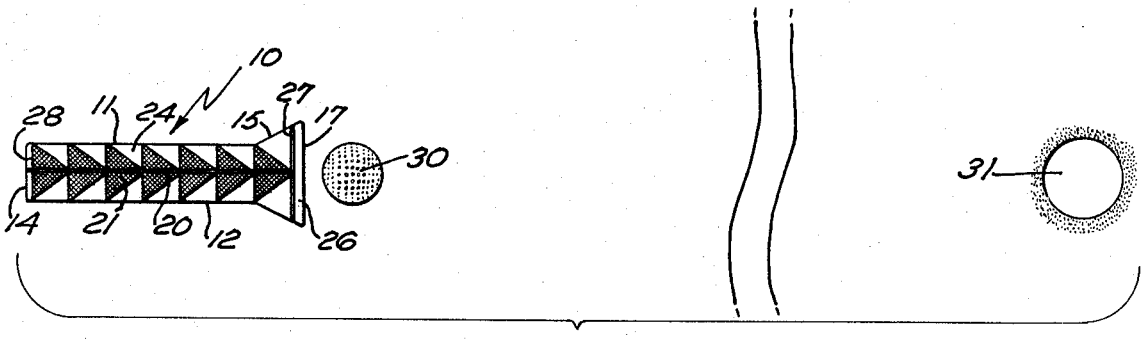
FIG. 2 is a top plan view illustrating the device in its relation to the golf ball for such short shots and also showing the hole which is intended to receive the ball.

In use, the device 10 as shown in FIG. 2 is placed just to the rear of the golf ball 30 with the direction line 20 extending in line with the hole 31 which is to receive the ball 30 and in this position the golfer may align the face of his club with the marker 27 or end 17 and then move the club with the face so aligned away from the ball along the direction line 20 and then forward along the direction line 20 to stroke the ball toward the hole 31. In this view the golfer will be generally above the device 10 and ball 30 so that he can see the face of the club and also move the club along the direction line 20 which will materially assist him in providing the proper arrangement of club face and stroke direction of the club.

Figure 3:
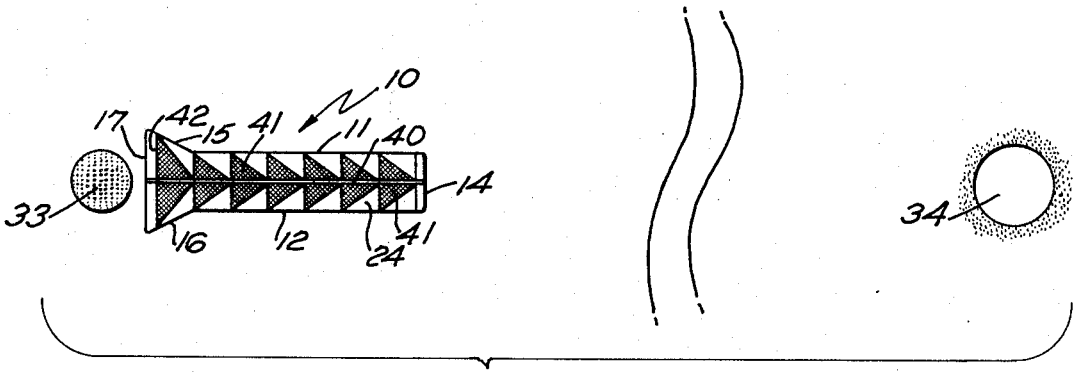
FIG. 3 is a top plan view showing the opposite side of the device and its position relative to the golf ball and showing the hole which receives the golf ball in the relationship which is used for longer shots such as from the tee or fairway.

In FIG. 3 the opposite side face of the device 10 is provided where it will be noted that the device is ahead of the ball 33 with the flared end placed adjacent the ball 33 and the direction line 40 on this opposite face will have the arrows 41 extending away from the flared end of the device and toward the hole 34, it being intended that this is the arrangement for a long stroke or off the tee or along the fairway in its use. Here the face of the golf club may still be aligned with the flared end 17 or the marking 42 on the second side of the device and by his eye the golfer may align his club face with these laterally extending portions 17 or 42 in moving the club rearwardly along an imaginary extension of the line 40 for stroking the ball.

I claim:

1. A device for aligning the face and swing of a golf club comprising an elongated body having two side surfaces with generally parallel edges flared at one end and terminating in ends at right angles to said edges, a direction line on each side surface extending longitudinally of said body midway between said edges, a series of arrows of generally triangular shape with a point end and a base end having said point end on said direction line and said base end at right angles thereto from side to side of said body, said arrows being raised from the face of the body and said two side surfaces each having arrows pointing in opposite directions.

2. A device as in claim 1 wherein the arrows are surfaced to contrast with the body.

3. A device as in claim 1 wherein a club face aligning mark extends laterally of said body and adjacent but spaced from the flared end thereof.

* * * * *